US007566413B2

(12) United States Patent
Piret et al.

(10) Patent No.: US 7,566,413 B2
(45) Date of Patent: Jul. 28, 2009

(54) METHOD FOR PROTECTING A TUYERE ASSEMBLY AND A REFRACTORY LINING OF A FURNACE

(75) Inventors: Jacques Piret, Liège (BE); Nicolas Mousel, Dudelange (LU); Roland Dhondt, Grembergen (BE); Emile Breden, Luxembourg (LU)

(73) Assignee: Paul Wurth S.A., Grand Duchy (LU)

( * ) Notice: Subject to any disclaimer, the term of this patent is extended or adjusted under 35 U.S.C. 154(b) by 118 days.

(21) Appl. No.: 10/594,263

(22) PCT Filed: Jan. 26, 2005

(86) PCT No.: PCT/EP2005/050317

§ 371 (c)(1),
(2), (4) Date: Sep. 26, 2006

(87) PCT Pub. No.: WO2005/093105

PCT Pub. Date: Oct. 6, 2005

(65) Prior Publication Data

US 2007/0200280 A1 Aug. 30, 2007

(30) Foreign Application Priority Data

Mar. 26, 2004 (EP) ..... 04101268

(51) Int. Cl.
*C21D 11/00* (2006.01)

(52) U.S. Cl. ..... 266/47; 266/99; 266/87

(58) Field of Classification Search ..... 266/44, 266/270, 285, 99, 87, 47
See application file for complete search history.

(56) References Cited

U.S. PATENT DOCUMENTS 5,328,157 A * 7/1994 Mantey ..... 266/47

FOREIGN PATENT DOCUMENTS

| | | | |
|---|---|---|---|
| EP | 0 121 617 | | 10/1984 |
| FR | 1 010 910 | | 6/1952 |
| SU | 1123021 A | * | 11/1984 |
| SU | 1442829 | | 12/1988 |

OTHER PUBLICATIONS

International Search Report; PCT/EP2005/050317; Aug. 23, 2005.

* cited by examiner

*Primary Examiner*—Scott Kastler
(74) *Attorney, Agent, or Firm*—Cantor Colburn LLP

(57) ABSTRACT

A method for protecting a tuyere assembly and a refractory lining of a furnace, and in particular a blast furnace, against damage caused by expansion of the refractory lining. This method includes providing a clearance between the tuyere assembly and a refractory lining portion below the tuyere assembly and monitoring this clearance by means of a displacement sensor.

11 Claims, 3 Drawing Sheets

METHOD FOR PROTECTING A TUYERE ASSEMBLY AND A REFRACTORY LINING OF A FURNACE

BACKGROUND OF THE INVENTION

The present invention relates to a method for protecting a tuyere assembly and a refractory lining of a furnace.

The interior of a shaft furnace, such as a blast furnace, is generally lined with a refractory material. The latter usually consists of items such as bricks or blocks, e.g. made from carbon, aluminium silicate or ceramic material, which are cemented for imperviousness and stability. Usually, different types of bricks or blocks are used in different zones, according to the predominant type of stress in the respective zone.

It is well known in the art that the refractory lining is subject to expansion. Basically two different effects can cause refractory lining expansion. A first effect is thermal expansion caused by the temperature increase of the refractory lining during start-up of the blast furnace. Thermal expansion is generally reversible. A second effect is referred to as "chemical expansion". This effect is due to chemical reactions that take place in the refractory material during its lifetime. Such chemical reactions cause an irreversible expansion of the refractory lining.

It will be noted that the refractory lining can find external bodies on the way of its expansion displacement. Such a situation occurs with the plurality of circumferentially arranged tuyere assemblies, which penetrate through the refractory lining into the blast furnace. As the refractory lining surrounds each of these tuyere assemblies, the latter can be on the way of the expansion of the wall lining. This can result in deformation of the tuyere assemblies and/or in a crushing of the expanding refractory lining under the tuyere assemblies.

To prevent unnecessary downtime and damage, it is important to take preventive measures. A known approach is to provide softening layers between refractory items, which compensate for dilatation of the refractory lining. They generally consist of thin, compressible and isolating joint plates. U.S. Pat. No. 3,805,466 describes such an approach. However, for stability and other reasons, the height of such known softening layers is limited. Thus, the summed vertical dimension of such layers is generally in the order of tenths of a percent of the summed vertical refractory lining dimension from furnace foundation to the tuyere assembly. Such layers can, at least partly, compensate for thermal expansion or dilatation of the refractory lining. However, they can normally not compensate for chemical expansion of the refractory lining. Indeed, chemical expansion is variable, generally irreversible and difficult, if not impossible, to predict. Moreover, chemical expansion is progressing over refractory lining service-life. With increasing extent of chemical expansion, the capability of the abovementioned layers to compensate for dilatation is reduced. Consequently, damage to the tuyere assemblies and/or the refractory lining cannot be efficiently prevented by known softening layers.

BRIEF SUMMARY OF THE INVENTION

The present invention provides a method for protecting a tuyere assembly and a refractory lining of a furnace against damage caused by expansion of a refractory lining. This method comprises the steps of providing a clearance between the tuyere assembly and a refractory lining portion below the tuyere assembly and monitoring this clearance by means of a displacement sensor. The clearance is a space deprived of refractory lining, usually consisting of an air gap or a gap filled with a compressible material. Advantageously, the clearance is provided immediately adjacent and underneath, preferably at the lower half of every tuyere assembly. Monitoring of the clearance warrants detection of critical expansion of the refractory lining during operation. More specifically, it warrants that the combined effect of thermal and chemical expansion is taken into account in preventive manner. Furthermore, the monitoring allows acquisition of information regarding the condition of the refractory lining, thereby contributing to preventive maintenance. It will be appreciated that monitoring of the clearance by means of a displacement sensor is not absolutely necessary on every tuyere assembly. By using additional information and mathematical methods, e.g. rotational symmetry of the furnace and interpolation, it is possible to estimate the expansion status of the lining below each tuyere assembly while having installed sensors only at some of the tuyere assemblies. However, it is also possible to provide multiple sensors to monitor the same clearance, thereby providing more detail and redundancy of measurements. In summary, the method according to the present invention provides a simple and reliable method of protecting tuyere assemblies and refractory lining in a furnace such as a shaft furnace and in particular a blast furnace. More specifically, the combined effect of thermal dilatation and chemical expansion is taken into account. Thus the method in accordance with the present invention increases service-life of tuyere assemblies as well as service-life of refractory lining.

Preferably at least one removable refractory layer is provided below the tuyere assembly. This removable refractory layer is then removed if, during operation of the furnace, monitoring of the clearance shows that the height of the clearance falls below a predetermined value. Proceeding this way circumvents the necessity of oversizing of the initial clearance for security reasons. Indeed, if necessary, clearance can be increased by simply removing at least one removable refractory layer. Preferably, the removable layer consists of solid refractory material being cemented to the adjacent refractory lining. Of course, it is also possible to replace the removed refractory layer by a new removable refractory layer of reduced thickness. It will be appreciated that the step of monitoring the clearance by means of the displacement sensor will provide necessary expansion information to decide when to remove the removable refractory layer.

Advantageously, the method further comprises sealing the clearance with a compressible sealing material. This sealing prevents dust accumulation within the clearance, which could reduce its effectiveness, and protects the sensor against a direct exposure to hot furnace gases.

Preferably, the method comprises continuously monitoring the clearance during operation of the furnace. This allows detection of critical expansion of the refractory lining, and possibly preventive shutdown of the furnace. Moreover continuous monitoring of the expansion allows for observation of the refractory condition during operation. For example, integrity of the refractory lining can be monitored. In this way, a shutdown can be initiated before further damage occurs.

Advantageously, the method further comprises monitoring the clearance during shutdown of the furnace. Thereby, contraction behaviour of the refractory lining portion below the tuyere assembly is determined.

Preferably, the method comprises monitoring the clearance during start-up of the furnace. Thereby, expansion behaviour of the refractory lining portion below the tuyere assembly is determined. This step allows for gathering further information on the refractory lining condition, for example verifying uniform circumferential expansion of the refractory lining. The data thus obtained can be used as additional feedback control information for controlled heating and controlled expansion during start-up of the furnace. This data can also contribute to process control, e.g. by giving information on build-up of skull and partition of the heat load. When combined to monitoring the clearance during operation of the furnace, this step contributes to the follow-up of the refractory lining behaviour during the furnace campaign. For instance, additional expansion monitored after the start-up period can be the sign of chemical expansion due to a chemical attack such as the alkali attack. In combination with monitoring the clearance during shutdown, opening of crevices in the refractory lining can be detected. Observation of reduced thermal contraction during the cooling of a shutdown, generally followed by an increased expansion of the refractory lining after the beginning of a subsequent start-up, can indicate the opening of crevices, which have then generally been infiltrated with metal.

Advantageously, the method further comprises providing a temperature sensor and monitoring temperature within the clearance between the tuyere assembly and the refractory lining portion to detect possible hot gas leakage. As mentioned above, the clearance should be sealed with suitable material. In case the sealing degrades, hot gases including dust particles from the furnace interior can penetrate the clearance. Such degradation can occur because of reduced wear resistance of the compressible sealing material, when compared to the refractory lining or the removable refractory layer.

The method according to the present invention preferably uses a linear electromechanical displacement sensor. A relatively simple induction type electromechanical displacement sensor is advantageously used, because of its robustness and reliability. Such a sensor preferably includes a sensor body mounted in a mounting hole of a tuyere cooler and a measuring pin slidingly supported by the sensor body, wherein the pin has a tip that is in contact with an upper surface of the refractory lining or the removable refractory layer. The sensor body is preferably mounted so as to engage the mounting hole in sealing manner. Mounting the sensor body into a mounting hole of a tuyere cooler provides cooling of the displacement sensor without extra expenditure. Advantageously, the tip of the pin consists of heat resistant material, such as ceramic, cermet or refractory steel. In another advantageous embodiment, at least part of the tip is breakable, which protects the sensor from possible damage.

The method according to the present invention can be applied to any type of shaft furnace, and in particular a blast furnace.

It will be appreciated that, although the above description mentions tuyere assemblies, the present invention can be applied to protect other stationary fixed elements penetrating a refractory lining of a furnace.

BRIEF DESCRIPTION OF THE FIGURES

The present invention will be more apparent from the following description of not limiting embodiments with reference to the attached drawings, wherein.

DETAILED DESCRIPTION

Figure 1:
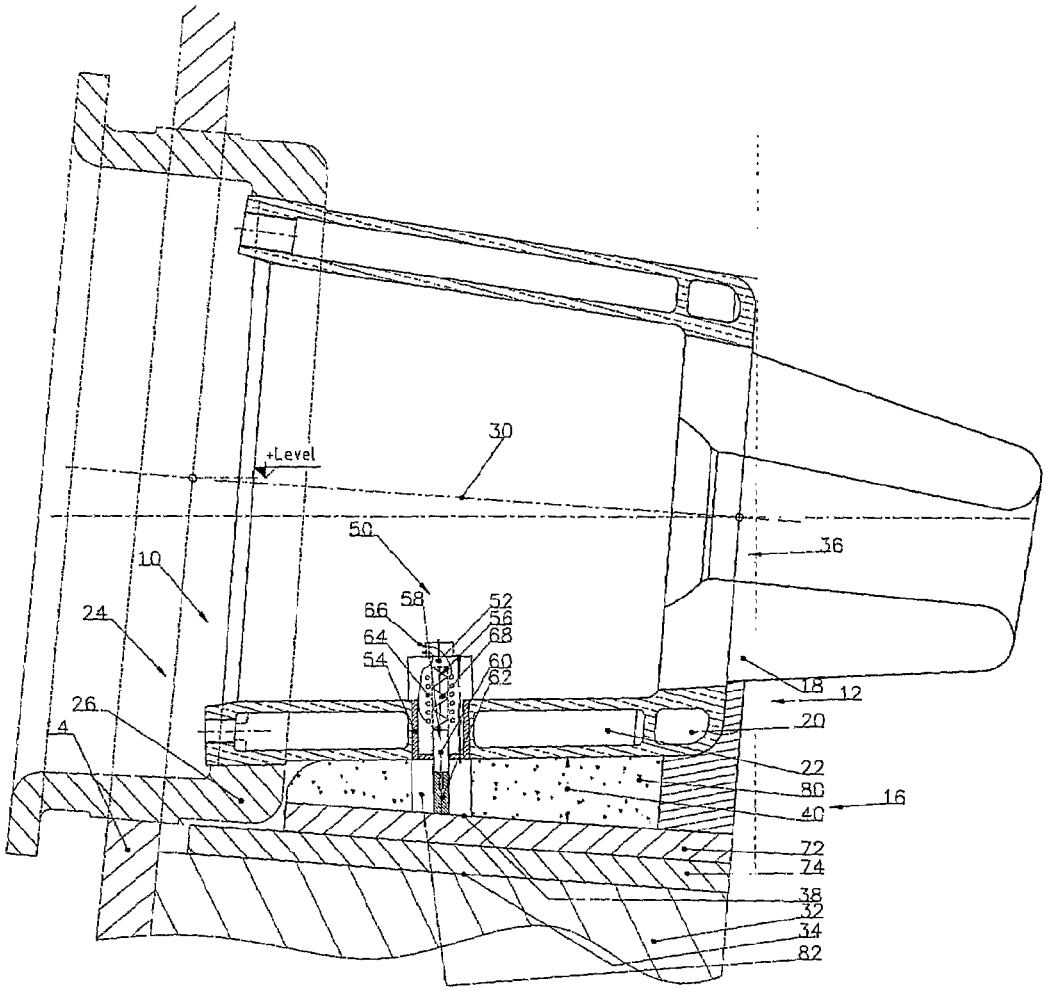
FIG. 1: is a vertical cross sectional view of a first embodiment of a blast furnace wall immediately below a tuyere assembly, with a first embodiment of a displacement sensor.

In FIG. 1, reference number 10 globally identifies a blast furnace wall immediately below a tuyere assembly 12, which is only shown in part. The blast furnace wall 10 comprises in a manner known per se an outer furnace shell 14 and an inner refractory lining 16. The tuyere assembly comprises in a manner known per se: a blast tuyere 18, a tuyere holder 20, a tuyere arc cooler 22 and a tuyere block 24 with a tuyere cooler holder 26. The tuyere block 24 is fixed, e.g. by welding, to a furnace shell 14. The tuyere arc cooler 22 is press-fit into the tuyere cooler holder 26 of the tuyere block 24, and the blast tuyere 18 is press-fit into the tuyere holder 20 of the tuyere arc cooler 22. The tuyere assembly 12 has a rotational symmetry with a symmetry axis 30.

Reference number 32 identifies a refractory block that is part of the refractory lining 16 below the tuyere assembly 12. The upper surface 34 of the refractory block 32 is a curved surface delimiting the lower part of a through-hole 36 in the refractory lining 16. The tuyere assembly 12 passes axially through the through-hole 36 in the refractory lining 16.

Arrow 40 identifies a clearance or gap between the tuyere assembly 12 and the upper surface 38 of the refractory lining portion 16, located below the tuyere assembly 12. The clearance 40 surrounds the lower half of the tuyere assembly 12.

According to an important aspect of the present invention, a displacement sensor 50 is provided to monitor the clearance 40, and more specifically the height of the clearance 40. This sensor 50 has a sensor body 52 mounted in sealed manner in a mounting hole 54 of the tuyere arc cooler 22. In the embodiments shown on the figures, the sensor 50 is an electromechanical linear displacement sensor based on inductivity measurement. The sensor body 52 has a cylindrical cavity 56 with a sensor pin 58 slidingly fitted therein. The pin 58 comprises a soft iron core 60 and a ceramic tip 62. The sensor body 52 includes a coil 64 with which the soft iron core 60 interacts as a plunger. Cast-in connectors 66 allow connection of measurement equipment. A spring 68 is associated with the sensor pin 58, so as to bias the ceramic tip 62 of the sensor pin 58 into mechanical contact with the upper surface 38 of removable refractory layers 72, 74 resting on the upper surface 34 of the refractory block 32.

Figure 2:
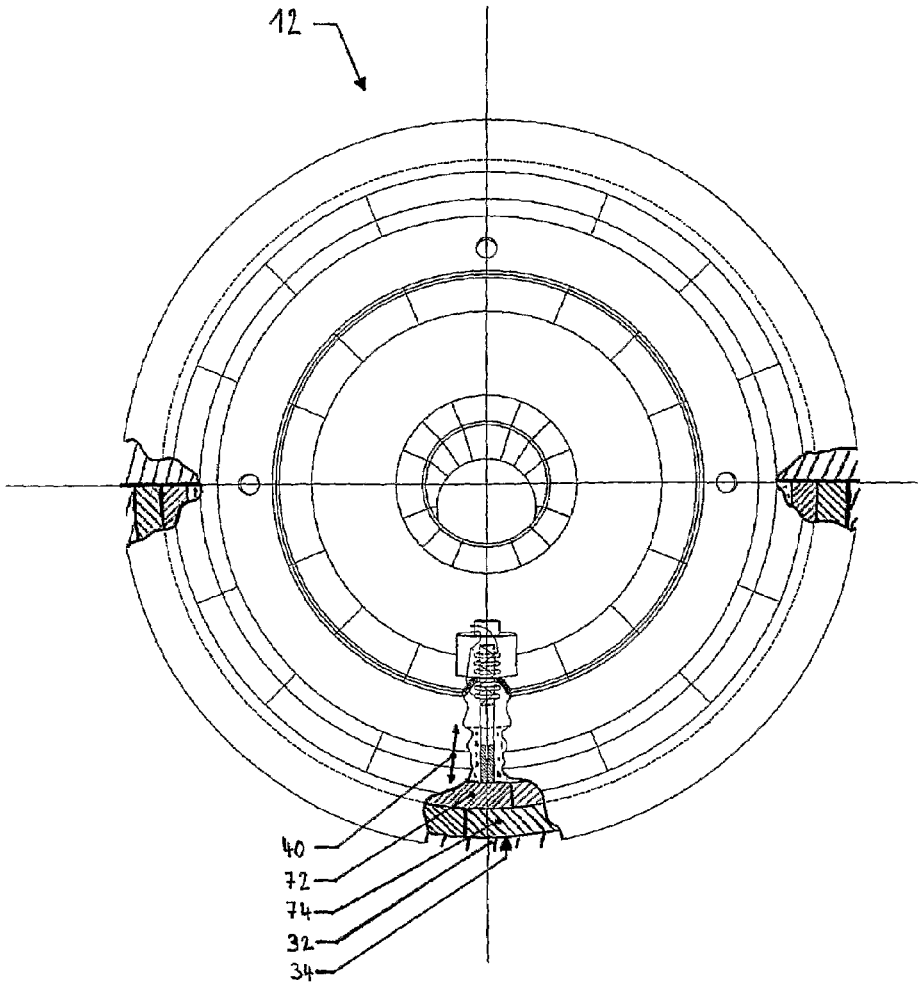
FIG. 2: is a partially cut rear view of the tuyere assembly of the first embodiment.

As shown in FIG. 2, the removable layers 72, 74 are provided below the tuyere assembly 12. At least one of the removable refractory layers 72, 74 is removed if the height of said clearance 40 is less than a predetermined value. The removable refractory layers 72, 74, when piled, fit onto the upper surface 34 of refractory block 32. They are preferably made of solid and durable material such as silicon carbide. Each of the removable refractory layers 72, 74 is, for ease of construction, composed of two arcuate elements. The latter elements define, when assembled a shell of U-shaped cross-section. The removable refractory layers 72, 74 allow to optimize the initial height of the clearance 40 to a minimum.

Returning to FIG. 1, reference number 80 identifies a compressible sealing material, which seals the clearance 40. The compressible sealing material 80 is provided within the clearance 40 between tuyere assembly 12 and the upper surface 38 of the removable refractory layer 72, or the refractory lining portion 16. It seals the clearance, while taking up expansion of the refractory lining 16. The compressible sealing material 80 is made of heat resistant, compressible material such as rock wool or preferably silica-alumina fibre. A free space 82 is provided within the compressible sealing material 80, around the sensor pin 58 for unimpeded movement of the latter.

In a first phase, the clearance 40 filled with the compressible sealing material 80, takes up or buffers expansion of the refractory lining 16 below the tuyere assembly 12. The expansion evolution is monitored by means of displacement sensor 50 to decide when the expansion is considered as excessive. In a subsequent second phase, when excessive expansion, more specifically permanent chemical expansion, is detected by displacement sensor 50, at least one removable layer 72, 74 is removed, for example pushed into the furnace. After removal of at least one removable layer 72, 74, the aforementioned initial clearance 40 will be enlarged by the height of the removed removable layer 72,74.

During operation of the blast furnace, the clearance 40, and more specifically the height of the clearance 40, is continuously monitored by displacement sensor 50. To perform monitoring, the displacement sensor 50 is connected to an inductivity measurement device, known per se, by means of connectors 66. An increase in temperature and/or chemical effect causes the refractory lining 16 below the tuyere assembly 12 to expand upwards such as to approach the lower half of the tuyere assembly 12. The upper surface 34 of the refractory lining 16 and, if still present, the removable layers 72, 74 are displaced upwards. As a result, pin 58 of sensor 50 will be pushed into the cylindrical cavity 56. As the soft iron core 60 further penetrates the coil 64, it modifies inductivity of the coil 64. Thus, the displacement sensor 50 serves to determine, when removal of, at least one of, the removable refractory layers 72,74, becomes necessary. This step of monitoring the clearance 40 warrants detection of critical expansion of the refractory lining 16 during operation and provides a means to allow preventive intervention. More specifically, the combined effect of thermal and chemical expansion is taken into account in preventive manner.

According to another aspect, the clearance 40 is monitored during shutdown of the blast furnace. Thereby contraction behaviour of the refractory lining portion 16 below the tuyere assembly 12 is determined. This monitoring is carried out, mutatis mutandis, in similar manner to what is described above. Information regarding the condition of the refractory lining 16 is acquired in this step, thereby contributing to preventive maintenance.

According to a further aspect, the clearance 40 is measured during start-up of the blast furnace. Thereby expansion behaviour of the refractory lining portion 16 below the tuyere assembly 12 is determined. This monitoring is carried out, mutatis mutandis, in similar manner to what is described above. Determining expansion behaviour during start-up gives important feedback information about the refractory lining 16 and the process.

Figure 3:
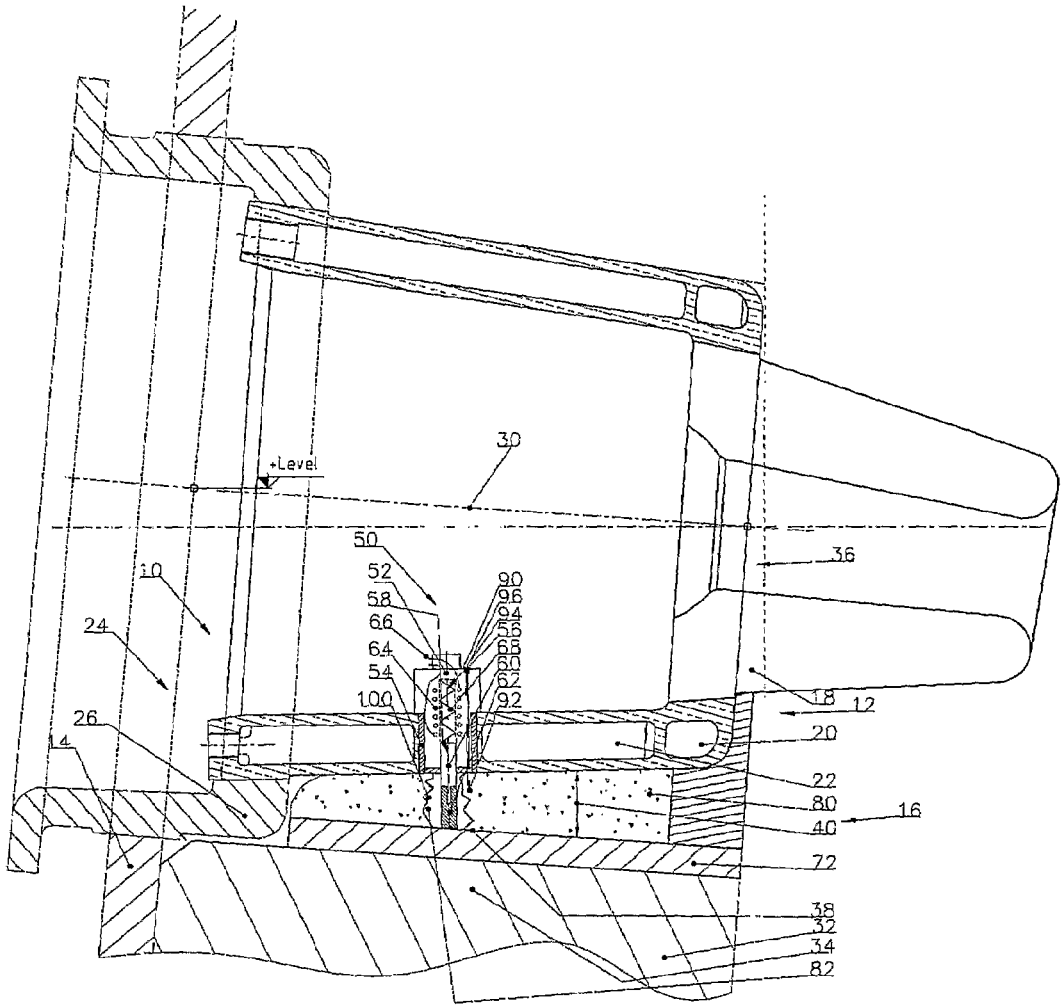
FIG. 3: is a vertical cross sectional view of a second embodiment of a blast furnace wall immediately below a tuyere assembly, with a second embodiment of a displacement sensor.

FIG. 3 shows a second, slightly different, embodiment. With regard to FIG. 1, like reference numbers identify like parts. In the embodiment of FIG. 3, only one removable refractory layer 72' is provided. Less total expansion being predicted in the embodiment of FIG. 3, the upper surface 34 of refractory block 32 is located at a higher vertical position within the blast furnace wall 10.

Reference number 90 identifies a temperature sensor with a probe tip 92. The probe tip 92 protrudes into the clearance 40 and the compressible sealing material 80 therein, ending at approximately a quarter of the height thereof. The temperature sensor 90 is mounted in a sheath 94 associated with the sensor body 52 of the displacement sensor 50. The temperature sensor 90 is connected to a measuring device by means of connector 96.

According to the present invention, temperature sensor 90 is used to monitor temperature within the clearance 40 between tuyere assembly 12 and refractory lining portion 16 in order to detect possible hot gas leakage. Such hot gas leakage can occur after a degradation of either the compressible sealing material 80 or the removable refractory layer 72'. Monitoring temperature within the clearance 40 helps to monitor the condition of compressible sealing material 80 and to determine when the latter is to be serviced.

Reference number 100 identifies a bellows expansion sheath surrounding sensor pin 58. Its upper end is sealingly connected to the sensor body 52. Its lower end is closed and biased against the upper surface 38 of the removable refractory layer 72'. The bellows expansion sheath 100 prevents the compressible sealing material 80 from impeding the displacement sensor 50, and more specifically the movement of sensor pin 58. In case of hot furnace gas leakage, bellows joint 100 also prevents dust particles to impair displacement sensor 50.

The following, not limiting, example illustrates improved protection:

EXAMPLE

| | |
|---|---|
| Height of lower refractory lining ($H_{rl}$): (from furnace foundation to tuyere centre line) | 10 m |
| Average buffering height (clearance + removable layer(s)) ($h_b$): | 125 mm |
| Expansion buffering capacity in percent ($H_{rl}/h_b$): (excluding compressible joint plates within refractory lining) | 1.25% |

The invention claimed is:

1. A method for protecting a tuyere assembly and a refractory lining of a furnace against damage caused by expansion of the refractory lining comprising:

providing a clearance between said tuyere assembly and a refractory lining portion below said tuyere assembly; and monitoring said clearance by means of a displacement sensor.

2. The method according to claim 1 further comprising:

providing at least one removable refractory layer below said tuyere assembly; and removing said at least one removable refractory layer if a height of said clearance is less than a predetermined value.

3. The method according to claim 1 further comprising: sealing said clearance with a compressible sealing material.

4. The method according to claim 1, further comprising: continuously monitoring said clearance during operation of said furnace.

5. The method according to claim 1, further comprising: monitoring said clearance during shutdown of said furnace thereby determining contraction behaviour of said refractory lining portion below said tuyere assembly.

6. The method according to claim 1, further comprising: monitoring said clearance during start-up of said furnace thereby determining expansion behaviour of said refractory lining portion below said tuyere assembly.

7. The method according to claim 1, further comprising: providing a temperature sensor and monitoring temperature within said clearance between said tuyere assembly and said refractory lining portion to detect possible hot gas leakage.

8. The method according to claim 1, wherein said displacement sensor is a linear electromechanical displacement sensor.

9. The method according to claim 8, wherein said displacement sensor includes:

a sensor body mounted in a mounting hole of a tuyere cooler; and a measuring pin slidingly supported by said sensor body, said pin having a tip that is in contact with an upper surface of said refractory lining portion or said removable refractory layer.

10. The method according to claim 9, wherein said tip of said pin comprises ceramic, cermet or refractory steel material.

11. The method according to claim 1, wherein said furnace is a shaft furnace, in particular a blast furnace.

* * * * *